US008028848B2

(12) United States Patent
Pugne et al.

(10) Patent No.: US 8,028,848 B2
(45) Date of Patent: Oct. 4, 2011

(54) NON-REMOVABLE CLOSURE/FINISH SYSTEM

(75) Inventors: Darin M. Pugne, Holland, OH (US); Scott Calmes, Toledo, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 1120 days.

(21) Appl. No.: 11/821,237

(22) Filed: Jun. 22, 2007

(65) Prior Publication Data

US 2008/0314860 A1 Dec. 25, 2008

(51) Int. Cl.
*B65D 41/04* (2006.01)

(52) U.S. Cl. ..... 215/330; 215/331

(58) Field of Classification Search ..... 215/216, 215/330, 331; 222/556; 220/782
See application file for complete search history.

(56) References Cited

U.S. PATENT DOCUMENTS

| | | | | |
|---|---|---|---|---|
| 2,028,490 | A | 1/1936 | Baker | |
| 3,770,153 | A | 11/1973 | Gach et al. | |
| 4,127,221 | A | 11/1978 | Vere | |
| 4,345,691 | A | 8/1982 | Burke | |
| 4,351,442 | A | 9/1982 | Summers | |
| 4,913,299 | A | 4/1990 | Petro | |
| 4,991,733 | A | 2/1991 | Marino | |
| 5,143,237 | A | 9/1992 | Lindsey et al. | |
| 5,145,080 | A | 9/1992 | Imbery, Jr. | |
| 5,271,512 | A | 12/1993 | Ekkert | |
| 5,307,946 | A | 5/1994 | Molinaro | |
| 5,360,127 | A | 11/1994 | Barriac et al. | |
| 5,454,476 | A | 10/1995 | King et al. | |
| 5,588,546 | A | 12/1996 | Farside | |
| 5,603,421 | A * | 2/1997 | Opresco | 215/217 |
| 5,685,445 | A | 11/1997 | Dobbs | |
| 5,908,125 | A * | 6/1999 | Opresco | 215/216 |
| 6,047,840 | A | 4/2000 | Moore et al. | |
| 2004/0104193 | A1 * | 6/2004 | Yashima et al. | 215/344 |
| 2005/0279781 | A1 * | 12/2005 | Pugne | 222/556 |
| 2006/0186077 | A1 * | 8/2006 | Robinson | 215/237 |
| 2008/0000932 | A1 * | 1/2008 | Cleary et al. | 222/215 |

FOREIGN PATENT DOCUMENTS

| | | |
|---|---|---|
| EP | 0179706 | 4/1986 |
| EP | 0633197 | 1/1995 |
| EP | 0812777 | 12/1997 |
| FR | 2036272 | 12/1970 |
| GB | 2189475 | 10/1987 |
| GB | 2122978 | 1/1994 |

OTHER PUBLICATIONS

PCT Notification, Search Report and Written Opinion Dated: Jun. 12, 2008 Int. Serial No. PCT/US2008/066715 Int Filing Date: Jun. 12, 2008.

* cited by examiner

*Primary Examiner* — Anthony Stashick
*Assistant Examiner* — James N Smalley
(74) *Attorney, Agent, or Firm* — Reising Ethington PC

(57) ABSTRACT

A container and closure package to provide secure threaded attachment of the closure to the container in a predetermined orientation and inhibits removal of the closure. A container neck finish has an external thread and an external annular ledge or flange therebelow having external locking recesses or notches. A closure includes an inner annular wall adapted for threaded engagement on the neck finish. A closure outer annular skirt wall inhibits tampering access to an intermediate annular locking lug wall disposed concentrically between the inner and outer skirt walls. Locking lugs protrude radially inwardly from the inner periphery of the intermediate annular wall and are disposed for snap receipt into the ledge locking notches as the closure is fully threaded onto the container neck finish.

11 Claims, 5 Drawing Sheets

NON-REMOVABLE CLOSURE/FINISH SYSTEM

This disclosure relates to a package in the form of an assembly of a container and closure for such container, and more particularly to a closure and container system in which the closure is non-removably secured to the container neck finish.

BACKGROUND AND SUMMARY OF THE DISCLOSURE

A common type of container has a threaded neck finish and is adapted to receive a threaded closure. In some applications there may be a need to precisely position the closure on the container neck finish when the closure is in fully assembled condition. For example, the closure may have an external feature that is intended to be maintained in some predetermined relationship with a cooperating external feature on the container. In some applications there also is a need for a removal-resistant closure on the container to provide a tamper-resistant package assembly, as well as a package assembly that would provide evidence of tampering.

In general, and by way of summary description and not by way of limitation, the present disclosure provides a package in the form of a container and closure assembly that incorporates a system for providing secure threaded attachment of the closure to the container in a predetermined orientation, and that inhibits removal of the closure as well as providing evidence of tampering efforts to effect closure removal. The container has a neck finish that defines an opening to the container interior and has at least one external thread segment. The neck finish also has an external annular ledge spaced below the thread segment. At least one, but preferably a pair of diametrically opposed external locking notches or recesses are provided in the ledge outer periphery.

The closure includes an inner annular wall provided with at least one internal thread segment for threaded engagement with an external thread segment on the neck finish. The closure also has an outer annular skirt wall that serves as a barrier to tampering access to an intermediate annular locking lug wall of the closure disposed concentrically between the inner wall and the outer skirt wall. At least one locking lug, but preferably a pair of diametrically opposed locking lugs protrude radially inwardly from the inner periphery of the intermediate annular wall. The locking lugs are disposed for snap receipt into the external ledge locking notches as the closure is fully threaded onto the container neck finish to thereby provide a predetermined orientation of the fully closed closure on the container and prevent unthreading of the closure from the neck finish.

BRIEF DESCRIPTION OF THE DRAWINGS

The foregoing, as well as objects, features and advantages of the present disclosure will become apparent from the following detailed description of the best mode presently known to the inventors of making and using the invention, from the appended claims and from the accompanying drawings (which are to engineering scale unless otherwise indicated), wherein:

DETAILED DESCRIPTION OF THE ILLUSTRATED EMBODIMENT

In accordance with a preferred but exemplary embodiment of the disclosure shown in FIGS. 1-12 of the drawings, a container package 20 comprises a hollow plastic container 22 having a body 24 and a neck/finish 26 integral therewith. (As used herein, the term "integral" means a one-piece construction as molded.) Container 22 preferably is conventionally blow molded to essentially finished form, and preferably is made of plastic material such as polyethylene terephthalate (PET).

Figure 3:
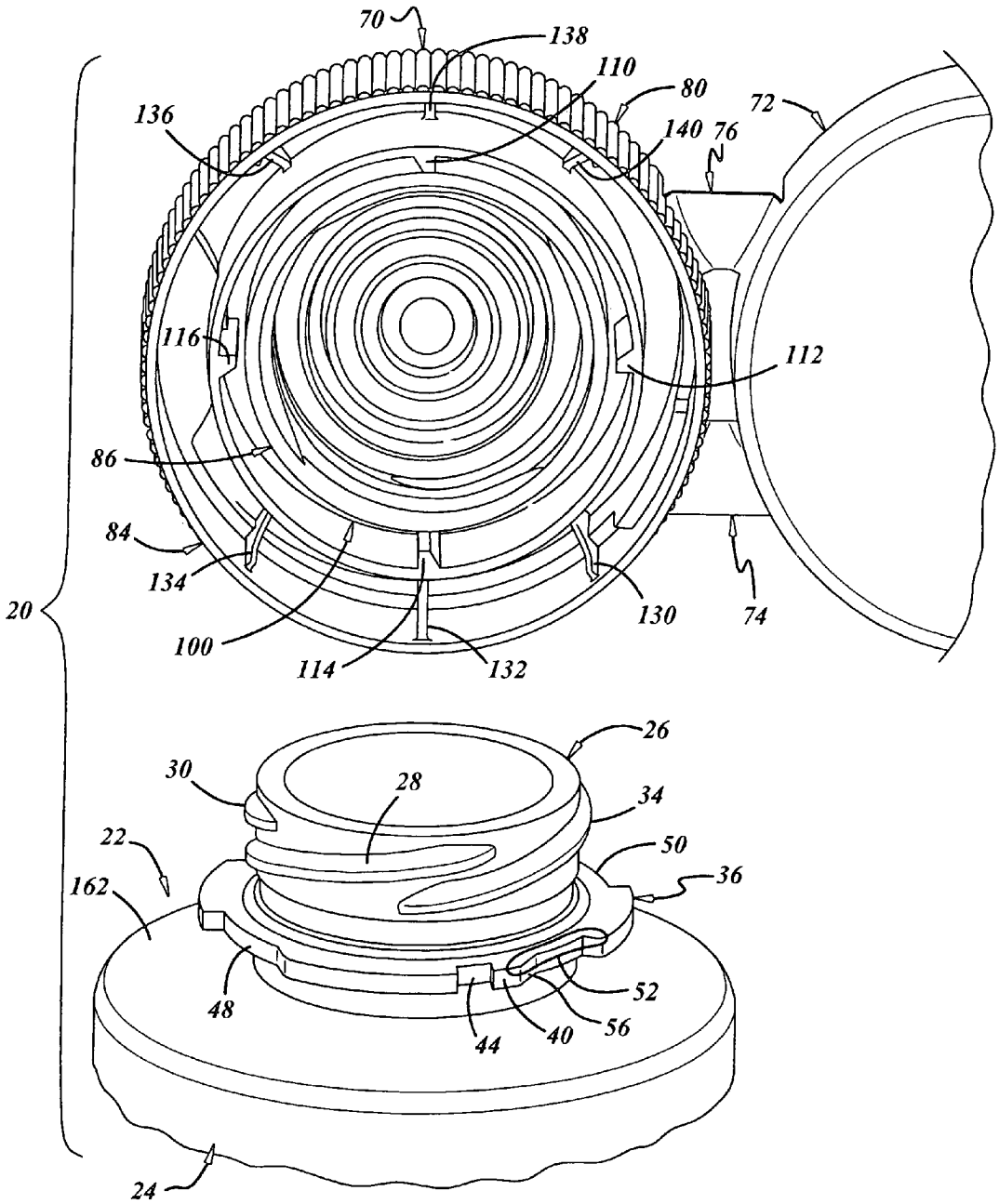
FIG. 3 is a fragmentary perspective view of the upper end of the container and associated finish and shown separated from the closure as viewed from the underside thereof with its associated hinged lid shown in open position.
Figure 4:
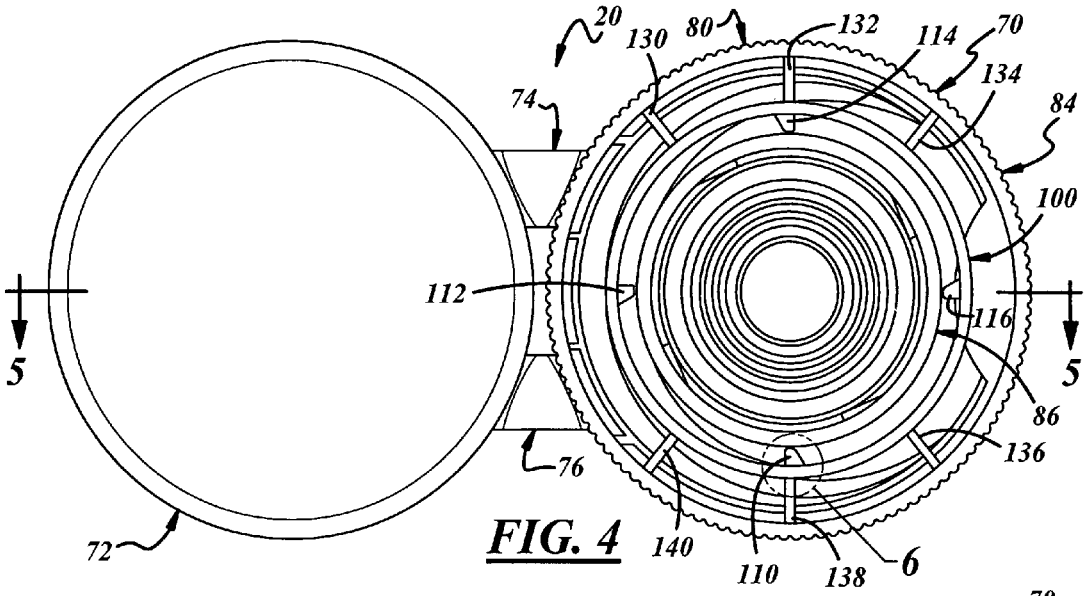
FIG. 4 is a bottom plan view of the closure with its associated lid shown in its open position.
Figure 5:
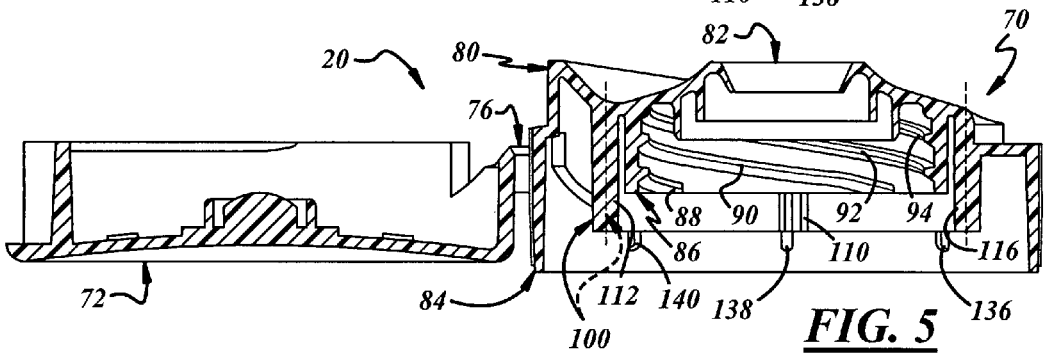
FIG. 5 is a cross sectional view taken on the line 5-5 of FIG. 4.
Figure 6:
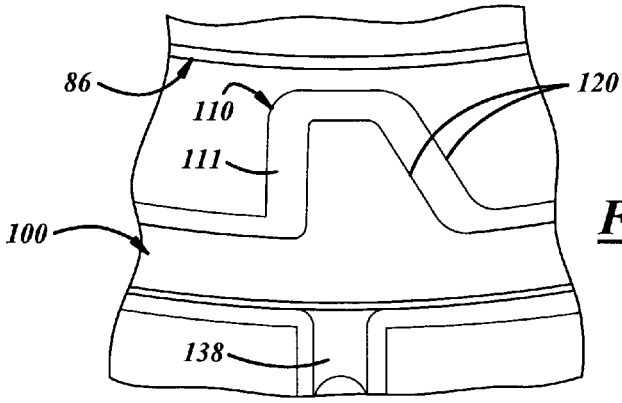
FIG. 6 is an enlarged fragmentary view showing the detail of one of the closure locking lugs contained within the phantom circle 6 of FIG. 4.
Figure 7:
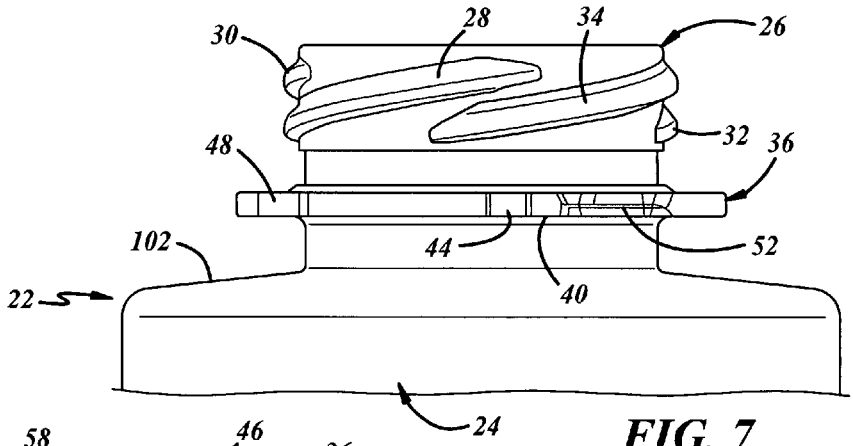
FIG. 7 is a fragmentary elevational view of the upper end of the container and its finish.
Figure 8:
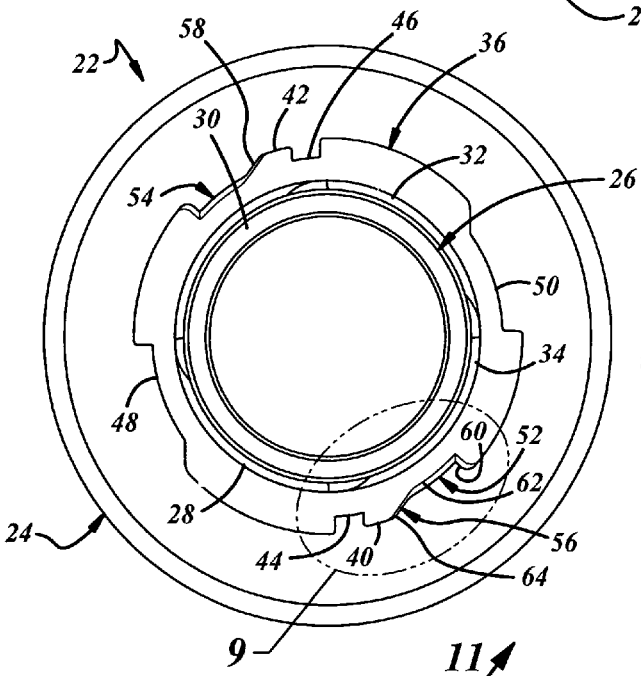
FIG. 8 is a top plan view of the upper end of the container and finish as seen in FIG. 7.
Figure 9:
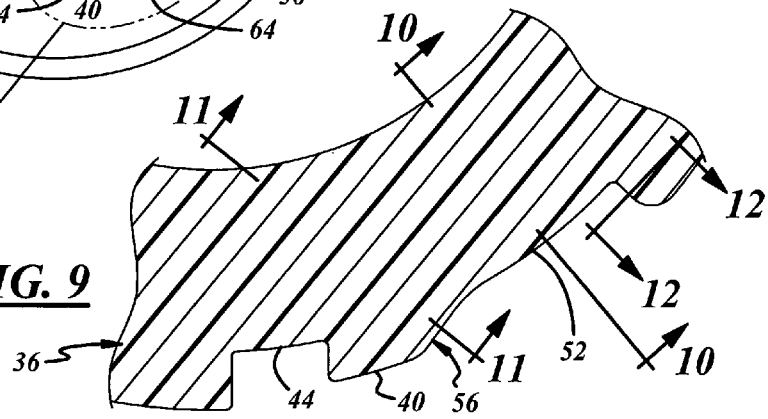
FIG. 9 is a greatly enlarged fragmentary cross sectional view of the portion of FIG. 8 encompassed by the circle labeled 9 in FIG. 8, and taken on the same section plane as line 2-2 of FIG. 1.

Preferably the container neck finish 26 has four external thread segments 28, 30, 32, 34 at 90° spacing (FIGS. 3, 7 and 8). Neck finish 26 also has an external flange or annular ledge 36 that extends 360° around the neck finish beneath the thread segments and spaced well above the top wall 102 of container 22. Flange 36 has two diametrically opposed locking lugs 40 and 42 (FIGS. 3, 7 and 8) respectively circumferentially adjacent locking recesses or notches 44 and 46. Flange 36 also has two relatively long clearance recesses or notches 48 and 50 diametrically opposite one another and at 90° spacing from the locking recesses 44 and 46.

Figure 10:
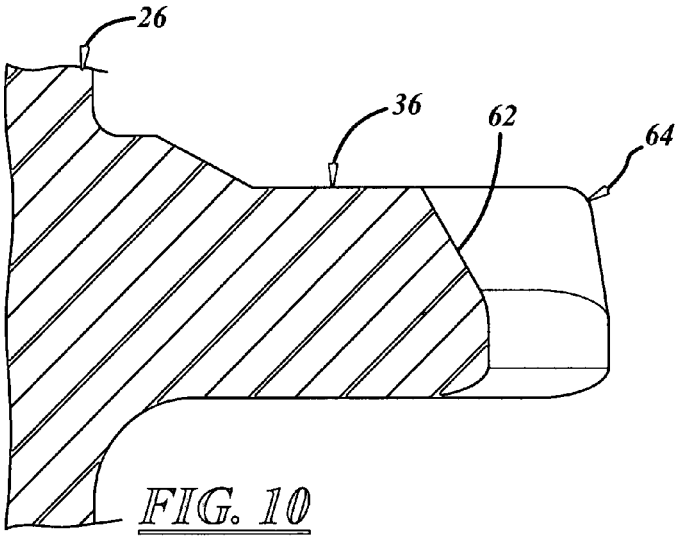
FIG. 10 is a fragmentary cross sectional view taken on the line 10-10 of FIG. 9.
Figure 12:
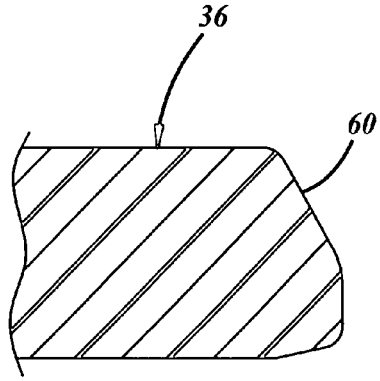
FIG. 12 is a fragmentary cross sectional view taken on the line 12-12 of FIG. 9.
Figure 11:
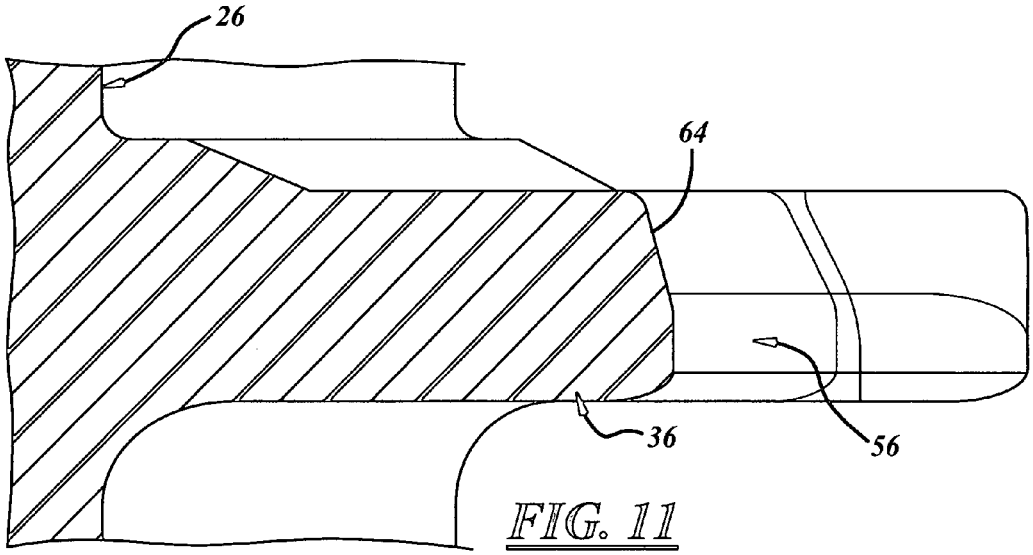
FIG. 11 is a fragmentary cross sectional view taken on the line 11-11 of FIG. 9.

Flange 36 also has a pair of diametrically opposed external lug lead-in recesses or notches 52 and 54 respectively circumferentially adjacent to each of the flange lugs 40 and 42. One edge 56 and 58 of recesses 52 and 54 respectively, which is closest to the associated locking lugs 40 and 42, is angled relative to the radius of finish 26 at a camming angle, such as about 60° (FIG. 2) in the plane of the drawing. As best seen in FIGS. 10, 11 and 12, the three upper edges of recesses 52 and 54, i.e., those edges closest to the open upper end of finish 26, are beveled to form camming chamfers 60 (FIG. 12), 62 (FIG. 10) and 64 (FIG. 11).

Figure 1:
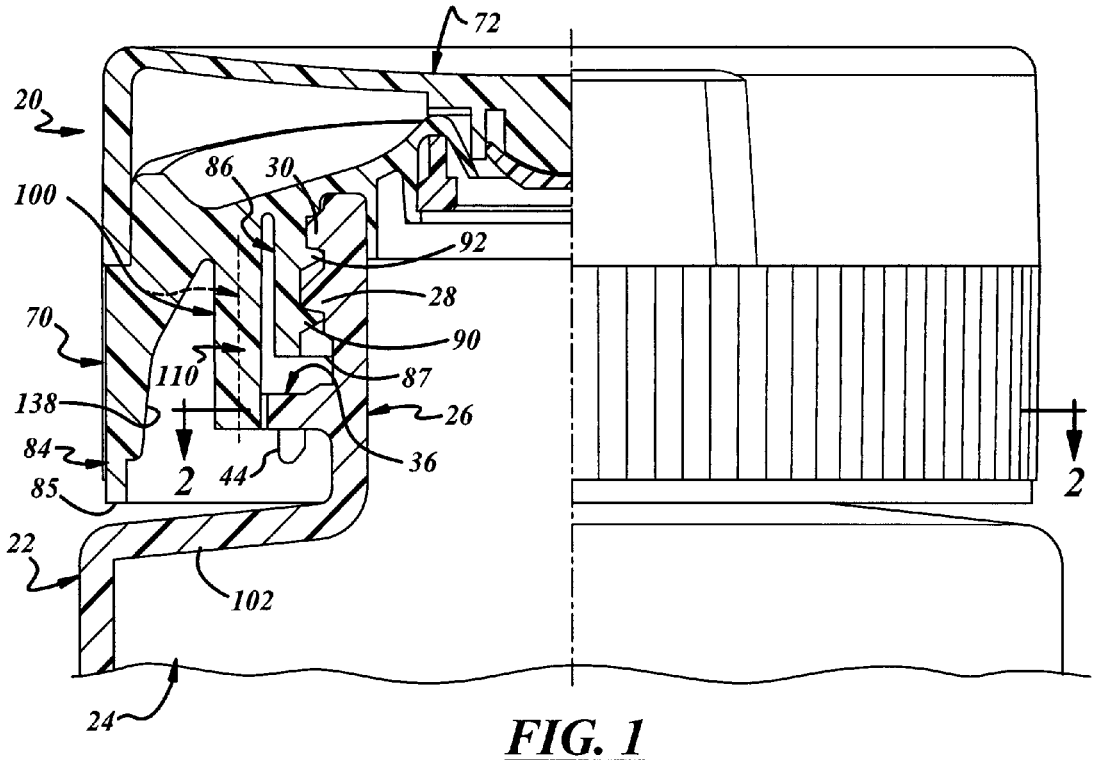
FIG. 1 is a fragmentary part elevational and part sectional view taken along the longitudinal centerline axis of the container and associated closure components of an exemplary but preferred embodiment of a liquid containing and dispensing package of the disclosure.
Figure 2:
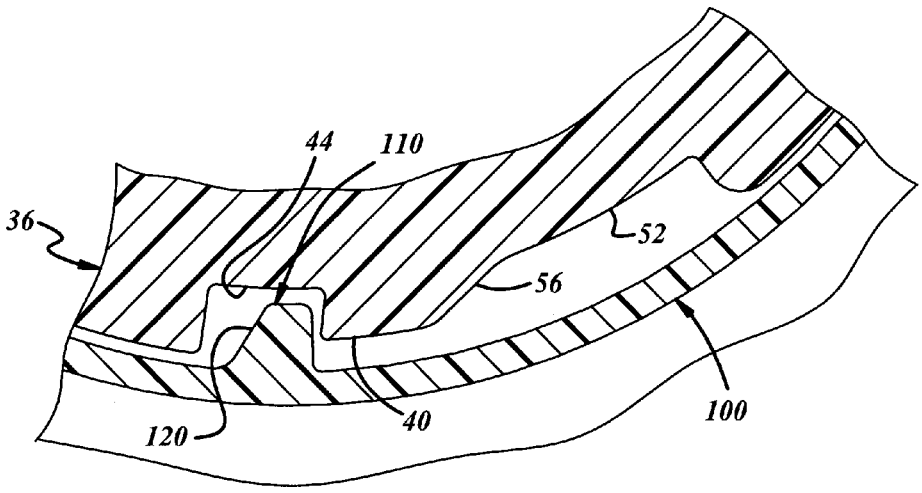
FIG. 2 is a fragmentary sectional view taken on the line 2-2 of FIG. 1.

Closure 70 of container package 20 is shown assembled to container 22 in FIG. 1 (in fully closed condition thereon) and is shown separately from container 22 in FIGS. 3, 4, 5 and 6. Closure 70 has a lid 72 connected by living hinges 74 and 76 to a cap 80 of closure 70, and is designed to cover and uncover a central dispensing opening 82 of cap 80. A dispensing valve is shown in dispensing opening 82, but this is strictly optional. Preferably closure 70 is injection molded of semi-resilient plastic material such as polypropylene (PP).

Closure 70 is characterized by cap 80 having three annular concentric walls, namely, (1) an outer annular wall or skirt 84 that may be serrated or ribbed for appearance and to facilitate for threading the closure onto neck finish 26, (2) an inner annular wall 86 having at least one, but preferably four internal thread segments 88, 90, 92 and 94 designed to individually cooperate with the preferred four finish thread segments 28, 30, 32 and 34, and (3) an intermediate annular locking wall 100. As best seen in FIG. 1, inner wall 86 extends axially a sufficient distance so that when fully engaged on finish 26, the bottom edge 87 of threaded inner cap wall 86 is spaced above the upper surface of ledge 36. The intermediate locking cap wall 100 extends axially sufficiently to axially overlap ledge 36 in the fully threaded-on condition of cap 70. Outer cap wall 84 preferably extends axially downwardly further than wall 100 so that, as shown in FIG. 1, in the fully threaded-on condition of closure 70 on neck finish 26, the lower edge 85 of outer wall 84 is spaced slightly above top wall 102 of container 22.

Intermediate closure locking wall 100 is provided with at least one and preferably four radially inwardly protruding stop lugs 110, 112, 114 and 116 on its inner peripheral surface and spaced apart at 90° increments circumferentially of wall 100. The leading side face 120 of lug 110 (and likewise as to lugs 112, 114 and 116) is angled inwardly and backwardly relative to the closure direction of rotation of cap 80 (in the illustrated embodiment cap 80 is provided with right-hand thread segments 88-94 such that clockwise rotation of cap 80 on finish 26 screws the cap 80 down on container 22 in the closing direction).

The outer annular skirt wall 84 is preferably provided with a series of circumferentially spaced stiffening ribs 130, 132, 134, 136, 138 and 140 integral with outer skirt wall 84 and protruding radially inwardly from the inner periphery thereof, and each having a scalloped contour axially of cap 70, as typified by rib 138 shown in FIG. 1. These scallop-shaped stiffening ribs 130-140 limit the flexibility of the outer skirt 84 in the vicinity of locking lugs 110 and 114 to thereby help resist tampering by prying. Although ribs 130-140 engage or are integral with the flexible intermediate annular wall 100 at their upper ends (closed ends), nevertheless these ribs still allow intermediate wall 100 to resiliently flex sufficiently radially of the cap for accommodating the camming-radially-outwardly and snap-radially-inwardly motion of lugs 110 and 114, as described in more detail hereinafter.

In operation, when applying closure cap 80 to container 22 by engaging the cap thread segments 88-94 with the container neck finish thread segments 28-34 and rotating cap 80 in a clockwise direction relative to container 22, one pair of diametrically opposed closure lugs 112 and 116 are guided into the longer finish ledge clearance notches or recesses 48 and 50. Simultaneously the other pair of diametrically opposed cap locking lugs 110 and 114 encounter the shorter associated camming lead-in notches or recesses 52 and 54 of neck ledge 36. Note that all finish ledge or flange notches or recesses are positioned in relation to the helix angle of the thread segments of the finish neck such that the closure lugs 110-116 are aligned with these associated notches or recesses as the closure is fully applied. To aid in this alignment, the aforementioned chamfers 60, 62 and 64 have been provided on the upwardly facing edge portions of camming notches or recesses 52 and 54. Thus, as cap 80 continues to be applied (screwed downwardly on finish thread segments 28-34 as viewed in FIG. 1), cap locking lugs 110 and 114 are initially cammed radially outwardly of ledge 36 by first engaging the chamfers 62 in notch or recess 52 (and like chamfers in notch or recess 54). Then as cap rotation continues the locking lugs are further cammed, radially outwardly by camming edges of walls 56 and 58 of notches or recesses 52 and 54, causing the intermediate wall 100 to flex radially outwardly in the vicinity of locking lugs 110 and 114. However, the other set of closure lugs 112 and 116 will not engage any camming lugs on ledge or flange 36. Instead, they will drop into and occupy the circumferentially elongated associated clearance notches or recesses 48 and 50 in flange or ledge 36 and thus travel circumferentially therealong without flexing wall 100 in the vicinity of lugs 112 and 116.

Further clockwise rotation of cap 80 on finish 26 will cause locking lugs 110 and 114 to register with ledge locking notches or recesses 44 and 46, whereupon the resilience of camming-stressed wall 100 will cause locking lugs 110 and 114 to snap into these associated locking notches or recesses 44 and 46. This will lock the cap 80 closure 70 in place fully closed on finish 26. Closure 70 will have limited back-off rotation once thus locked in place due to the slightly greater circumferential extent of finish locking notches or recesses 44 and 46 relative to locking lugs 110 and 114. However, such opening rotational forces on locking lugs 110 and 114 will not cam them radially outwardly of associated locking notches or recesses 44 and 46 because the trailing wall 111 (FIG. 6) of each cap locking lug 110, 114 is oriented radially of cap 70, as are the circumferentially opposed end edges of each flange locking notch 44 and 46.

From the foregoing, it now will be understood that once closure cap 70 is fully secured onto finish 36 with the cap lugs 110 and 114 registered and protruding into the locking notches or recesses 44 and 46 of finish ledge 36, an ultimate purchaser or user of the container package 20 will have great difficulty in trying to gain access to the flexible intermediate locking wall 100. Outer wall 84 will prevent most if not all attempts to pry out the locking lugs 110, 114 from their locking recesses an attempt to defeat the non-removable feature of the package 20. The locking lugs 110, 114 cannot be disengaged from the finish locking recesses by inserting a screwdriver or the like beneath the outer skirt and prying it outwardly because the locking lugs are not carried by this cap skirt wall. Moreover, because the closure 20 when fully locked on container 22 disposes lower edge 85 of outer skirt wall 84 closely spaced axially above container wall 102, it is difficult to even engage or reach intermediate wall 100 by inserting a screwdriver or the like beneath outer skirt 84.

In addition, because in this preferred embodiment there is a pair of diametrically opposed locking lugs 110 and 114 engaged in locking relation with finish flange 36, both of these diametrically opposite locking lugs would have to be disengaged simultaneously from their associated flange locking recess in order to initiate unscrewing rotation of the closure from the container. Moreover, since locking lugs 110 and 114 are not visible exteriorly of the fully locked-on closure, the putative tamperor would first have to attempt to find the circumferential location of the hidden locking lugs before attempting any unseating action, the outer wall 84 thereby rendering it even more difficult to defeat the non-removable closure feature of package 20.

It is to be understood that in the illustrated exemplary embodiment, there are four lugs 110, 112, 114 and 116 on the interior intermediate wall 100, because there are four thread starts or thread segments 28, 30, 32 and 34 on the container neck finish 26. In those embodiments or applications where only two thread starts are required, only two diametrically opposed internal lugs 110-116 would be needed to effect the non-removability feature. That is, it will be understood that the sole functions of the circumferentially elongated notches 48 and 50 in the neck ledge 36 is to provide a location for receiving and accommodating circumferential travel of the diametrically opposed dormant closure lugs, i.e., lugs 112 and 116 in the foregoing example, that are not cammed out to be captured in locking elongate recesses 44 and 46 behind the finish lugs 40 and 42. In a two-thread modification there would be only two internal lugs on the closure skirt, and non-locking notches 48 and 50 would not be needed on the container neck flange 36.

In addition to the foregoing variations, it will be readily apparent from the foregoing detailed description of the invention and from the illustrations thereof in the drawings, that numerous variations and modifications may be effected without thereby departing from the principles of the invention and valid scope of the following claims.

The invention claimed is:

1. A closure and container package that includes:

a container having a wall with a neck finish for dispensing flowable container contents, said neck finish having at least one external thread segment and an external ledge spaced from said thread and from said container wall and having a first external locking recess in said ledge, and a non-removable closure that includes an inner annular wall with at least one internal thread segment for engagement with said first external thread on said neck finish, an outer skirt wall, an intermediate annular wall radially between said inner wall and said outer skirt wall and extending axially sufficiently to overlap said external ledge of said container neck finish having said locking recess, and a first internal lug on said intermediate annular wall protruding radially inwardly from said intermediate annular wall, said first internal lug being disposed for receipt into said first external locking recess as said closure is threaded onto said container neck finish to prevent unthreading of said closure from said neck finish, wherein a second internal lug is disposed on said intermediate annular wall diametrically opposed to said first internal lug, wherein said ledge has a second external locking recess diametrically opposed to said first external locking recess, and wherein a second internal lug is disposed on said intermediate wall for receipt into said second external locking recess as said closure is threaded onto said container neck finish to further prevent unthreading of said closure from said neck finish, wherein said outer annular wall serves as a barrier to tampering access to said intermediate annular wall.

2. The package of claim 1 that includes first and second sets of stiffening ribs integral with an interior side of said outer skirt wall and arrayed in circumferentially spaced relationship in the vicinities respectively of said first and second lugs.

3. The package of claim 2 wherein each of said internal lugs on said intermediate annular wall has a leading face surface relative to the direction of rotation of said closure in a closing direction of said container neck finish, said leading surface being inclined backwardly relative to a radius of said closure.

4. A closure and container package that includes:

a container having a wall with a neck finish for dispensing flowable container contents, said neck finish having at least one external thread segment and an external ledge spaced from said thread and from said container wall and having a first external locking recess in said ledge, and a closure that includes an inner annular wall with at least one internal thread segment for engagement with said first external thread on said neck finish, an outer skirt wall, an intermediate annular wall between said inner wall and said outer skirt wall, and a first internal lug on said intermediate annular wall, said first internal lug being disposed for receipt into said first external locking recess as said closure is threaded onto said container neck finish to prevent unthreading of said closure from said neck finish, wherein a second internal lug is disposed on said intermediate annular wall diametrically opposed to said first internal lug, wherein said ledge has a second external locking recess diametrically opposed to said first external locking recess, and wherein a second internal lug is disposed on said intermediate wall for receipt into said second external locking recess as said closure is threaded onto said container neck finish to further prevent unthreading of said closure from said neck finish, first and second sets of stiffening ribs integral with an interior side of said outer skirt wall and arrayed in circumferentially spaced relationship in the vicinities respectively of said first and second lugs, wherein each of said internal lugs on said intermediate annularwall has a leading face surface relative to the direction of rotation of said closure in a closing direction of said container neck finish, said leading surface being inclined backwardly relative to a radius of said closure, wherein said ledge has first and second camming recesses respectively adjacent said first and second locking recesses for receiving an associated internal lug as said closure is threaded down toward closed position on said finish, said camming recesses being shaped to produce a radially outward camming action on said associated lug in response to closing rotational and axial forces produced by relative rotational engagement of said thread segments to thereby force said lugs radially outwardly along said ledge just prior to registering with the associated external ledge locking recess, said intermediate wall having sufficient flexibility and resilience to allow such radially outwardly flexing and to cause said lugs to then snap into the associated locking external recess.

5. The package of claim 4 wherein said inner wall has third and fourth internal lugs disposed thereon diametrically opposed to one another and at generally 90° spacing from said first and second internal lugs, and wherein said ledge has third and fourth clearance recesses therein located to receive said third and fourth lugs respectively when the same register therewith as said first and second lugs register with the associated first and second camming recesses, said third and fourth ledge clearance recesses having a circumferential length sufficient to permit free travel therein of said third and fourth lugs as said first and second lugs travel to and register with the locking recesses during closing rotational motion of the closure as it is threaded down to closed position on the neck finish thread segments.

6. A closure and container package that includes:

a container having a neck finish with at least one external thread segment, an external ledge spaced from said thread segment and a pair of diametrically opposed external locking notches in said ledge, and a non-removable closure that includes an inner annular wall with at least one internal thread segment for engagement with said external thread segment on said neck finish, an outer skirt wall axially covering said inner annular wall, an intermediate annular wall radially between said inner wall and said outer skirt wall and extending axially sufficiently to overlap said external ledge of said container neck finish having said locking notches and also being axially covered by said outer skirt wall, and at least one pair of diametrically opposed internal locking lugs carried on and protruding radially inwardly from said intermediate annular wall, said internal locking lugs being disposed for snap receipt into said external locking notches as said closure is threaded onto said container neck finish to prevent unthreading of said closure from said neck finish, wherein said outer annular wall serves as a barrier to tampering access to said intermediate annular wall.

7. A non-removable closure that includes an inner annular wall with at least one internal thread segment for engagement with a container neck finish, an outer skirt wall, an intermediate annular wall radially between said inner wall and said outer skirt wall and extending axially sufficiently to overlap an external ledge of the container neck finish having locking notches, and a first internal lug protruding radially inwardly from said intermediate annular wall, said first internal lug being disposed for receipt into an external locking recess on a container as said closure is threaded onto the container neck finish to prevent unthreading of said closure from said neck finish, wherein a second internal lug protrudes radially inwardly from said intermediate annular wall diametrically opposed to said first internal lug for receipt into a second external locking recess on the container as said closure is threaded onto the container neck finish to further prevent unthreading of said closure from said neck finish, wherein said outer annular wall serves as a barrier to tampering access to said intermediate annular wall.

8. The closure of claim 7 that includes first and second sets of stiffening ribs integral with an interior side of said outer skirt wall and arrayed in circumferentially spaced relationship in the vicinities respectively of said first and second lugs.

9. The closure of claim 8 wherein each of said internal lugs on said intermediate annular wall has a leading face surface relative to the direction of rotation of said closure in a closing direction of a container neck finish, said leading surface being inclined backwardly relative to a radius of said closure.

10. A closure that includes an inner annular wall with at least one internal thread segment for engagement with a container neck finish, an outer skirt wall, an intermediate annular wall between said inner wall and said outer skirt wall, and a first internal lug on said intermediate annular wall, said first internal lug being disposed for receipt into an external locking recess on a container as said closure is threaded onto the container neck finish to prevent unthreading of said closure from said neck finish, wherein a second internal lug is disposed on said intermediate annular wall diametrically opposed to said first internal lug for receipt into a second external locking recess on the container as said closure is threaded onto the container neck finish to further prevent unthreading of said closure from said neck finish first and second sets of stiffening ribs integral with an interior side of said outer skirt wall and arrayed in circumferentially spaced relationship in the vicinities respectively of said first and second lugs, wherein each of said internal lugs on said intermediate annular wall has a leading face surface relative to the direction of rotation of said closure in a closing direction of a container neck finish, said leading surface being inclined backwardly relative to a radius of said closure, wherein said inner wall has third and fourth internal lugs disposed thereon diametrically opposed to one another and at generally 90° spacing from said first and second internal lugs.

11. A method of providing a tamper-resistant closure and container package that includes the steps of:

(a) providing a container having a neck finish with at least one external thread segment, an external ledge spaced from said thread segment and a pair of diametrically opposed external locking recesses in said ledge, and (b) providing a non-removable closure that includes an inner annular wall with at least one internal thread segment for engagement with said external thread segment on said neck finish, an outer skirt wall axially covering said inner annular wall, and an intermediate annular wall radially between said inner wall and said outer skirt wall and also being axially covered by said outer skirt wall and extending axially sufficiently to overlap said external ledge of said container neck finish having said locking recesses, (c) providing at least one pair of diametrically opposed internal locking lugs carried on and protruding radially inwardly from said intermediate annular wall disposed for snap receipt into said external locking notches as said closure is threaded onto said container neck finish to prevent unthreading of said closure from said neck finish, and (d) threading said closure onto said neck finish, wherein said outer annular wall serves as a barrier to tampering access to said intermediate annular wall.

* * * * *